US005172665A

United States Patent [19]

Kuroda

[11] Patent Number: 5,172,665

[45] Date of Patent: Dec. 22, 1992

[54] IDLE RUNNING CONTROL APPARATUS FOR INTERNAL COMBUSTION ENGINE

[75] Inventor: Toshiki Kuroda, Himeji, Japan

[73] Assignee: Mitsubishi Denki Kabushiki Kaisha, Tokyo, Japan

[21] Appl. No.: 791,231

[22] Filed: Nov. 13, 1991

[30] Foreign Application Priority Data

Nov. 16, 1990 [JP] Japan ..... 2-312203
Nov. 16, 1990 [JP] Japan ..... 2-312204

[51] Int. Cl.[5] ..... F02D 41/16
[52] U.S. Cl. ..... 123/339
[58] Field of Search ..... 123/339, 479, 481, 585

[56] References Cited

U.S. PATENT DOCUMENTS 4,376,427 3/1983 Mizuno ..... 123/339
5,035,220 7/1991 Uchinami et al. ..... 123/481 X
5,080,061 1/1992 Nishimura ..... 123/339

FOREIGN PATENT DOCUMENTS 131841 8/1982 Japan .
271659 10/1989 Japan ..... 123/339

*Primary Examiner*—Tony M. Argenbright

*Attorney, Agent, or Firm*—Sughrue, Mion, Zinn, Macpeak & Seas

[57] ABSTRACT

An idle running control apparatus for an internal combustion engine includes sensors for sensing the rotational speed or angular velocity of the engine, the opening degree of a throttle valve and the flow rate of intake air sucked into the engine, respectively. A misfiring determiner determines an occurrence of misfiring in the engine when a change in magnitude of the engine rotational speed exceeds a predetermined value. An idle speed adjuster adjusts the flow rate of intake air bypassing the throttle valve during idling so as to properly adjust the idle running speed of the engine. A controller is responsive to the outputs of the detectors and the misfiring determiner for controlling the idle running speed adjuster through feedback control with a control gain previously set such that a desired engine rotational speed is thereby attained. Upon occurrence of misfiring, in one aspect of the invention, the controller decreases the control gain so that the idle speed adjuster is thereby controlled to increase the idle running speed. In another aspect, the controller sets the desired rotational speed to a higher or greater value. Thus, hunting and an engine stall during the idle running operation of the engine can be prevented.

10 Claims, 6 Drawing Sheets

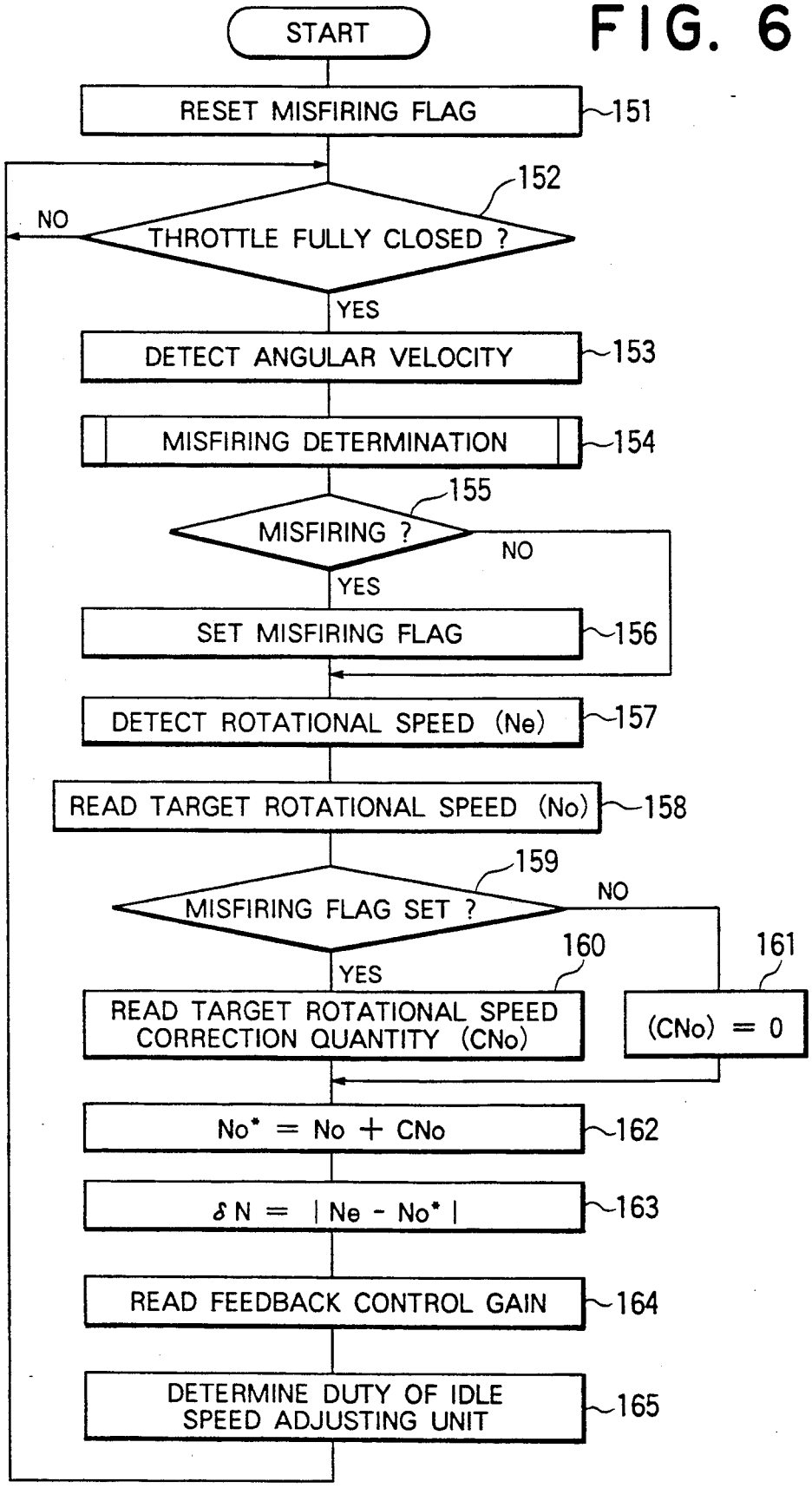
FIG. 6
START
RESET MISFIRING FLAG
151
152
THROTTLE FULLY CLOSED ?
NO
YES
DETECT ANGULAR VELOCITY
153
MISFIRING DETERMINATION
154
155
MISFIRING ?
NO
YES
SET MISFIRING FLAG
156
DETECT ROTATIONAL SPEED (Ne)
157
READ TARGET ROTATIONAL SPEED (No)
158
159
MISFIRING FLAG SET ?
NO
YES
160
161
READ TARGET ROTATIONAL SPEED CORRECTION QUANTITY (CNo)
(CNo) = 0
No* = No + CNo
162
δN = | Ne - No* |
163
READ FEEDBACK CONTROL GAIN
164
DETERMINE DUTY OF IDLE SPEED ADJUSTING UNIT
165

IDLE RUNNING CONTROL APPARATUS FOR INTERNAL COMBUSTION ENGINE

BACKGROUND OF THE INVENTION

The present invention generally relates to an idle running control apparatus for an internal combustion engine such as of a motor vehicle or car. More particularly, the invention is concerned with a method and an apparatus for protecting the internal combustion engine against the occurrence of misfiring to suppress a resultant hunting phenomenon and an engine stall during idle running operation to thereby ensure a stable operation of the engine.

In an idle running control apparatus for an internal combustion engine known heretofore, the engine rotational number or speed (rpm) is successively measured and feedback control of the engine speed is performed with a predetermined constant gain so that a desired engine rotational speed can be attained while correcting the control gain based on the atmospheric pressure, as disclosed, for example, in Japanese Patent Application Laid-Open No. 131841/1982 (JP-A-57-131841).

However, the known idle running control apparatus is not provided with any measure to cope with the occurrence of misfiring. Consequently, when misfiring occurs in an engine cylinder, a so-called hunting phenomenon takes place in the engine operation notwithstanding the feedback control as mentioned above, giving rise to a problem that the comfortableness in driving a motor vehicle is significantly detracted. In this conjunction, it is further noted that when the desired rotational speed for the normal idle operation is set as low as permissible in order to evade or alleviate hunting or significant fluctuations in the engine speed due to misfiring, there may arise an unwanted situation that the engine is stalled upon the occurrence of misfiring if the predetermined feedback control continues to be effected.

SUMMARY OF THE INVENTION

In the light of the state of the art described above, it is therefore an object of the present invention to provide an idle running control apparatus for an internal combustion engine which is capable of suppressing hunting as well as fluctuations in the engine speed resulting from misfiring during idling, while avoiding an engine stall.

In view of the above and other objects which will become more apparent as description proceeds, there is provided according to the invention an idle running control apparatus for an internal combustion engine, comprising: a rotational speed sensor for sensing the rotational speed of the engine and generating a corresponding output signal; a throttle sensor for sensing the degree of opening of a throttle valve and generating a corresponding output signal; an intake air sensor for sensing the flow rate of intake air sucked into the engine and generating a corresponding output signal; a misfiring determiner for determining an occurrence of misfiring in the engine on the basis of a change in magnitude of the output signal of the rotational speed sensor; idle speed adjusting means for adjusting the idle running speed of the engine; and control means responsive to the outputs of the rotational speed sensor, the throttle sensor and the intake air sensor and the misfiring determiner for controlling the idle speed adjusting means through feedback control with a control gain previously set such that a desired engine rotational speed is thereby attained.

According to one aspect of the invention, when the misfiring determiner determines an occurrence of misfiring, the control means decreases the control gain in the feedback control so that the idle speed adjusting means is thereby controlled to increase the idle running speed of the engine.

Preferably, the control gain is decreased in dependence on a difference between the actual running speed of the engine and a desired running speed which is previously determined in correspondence with the temperature of the engine.

According to another aspect of the invention, when the misfiring determiner determines an occurrence of misfiring, the control means increases the desired rotational speed by a predetermined amount.

Preferably, the predetermined amount is determined in correspondence to the temperature of the engine.

These and other advantages and attainments of the present invention will become apparent to those skilled in the art upon a reading of the following detailed description when taken in conjunction with the accompanying drawings.

BRIEF DESCRIPTION OF THE DRAWINGS

FIG. 6 is a flow chart for illustrating the idle running control according to a second embodiment of the invention.

DESCRIPTION OF THE PREFERRED EMBODIMENTS

The present invention will now be described in detail in conjunction with preferred or exemplary embodiments thereof by reference to the accompanying drawings.

Figure 1:
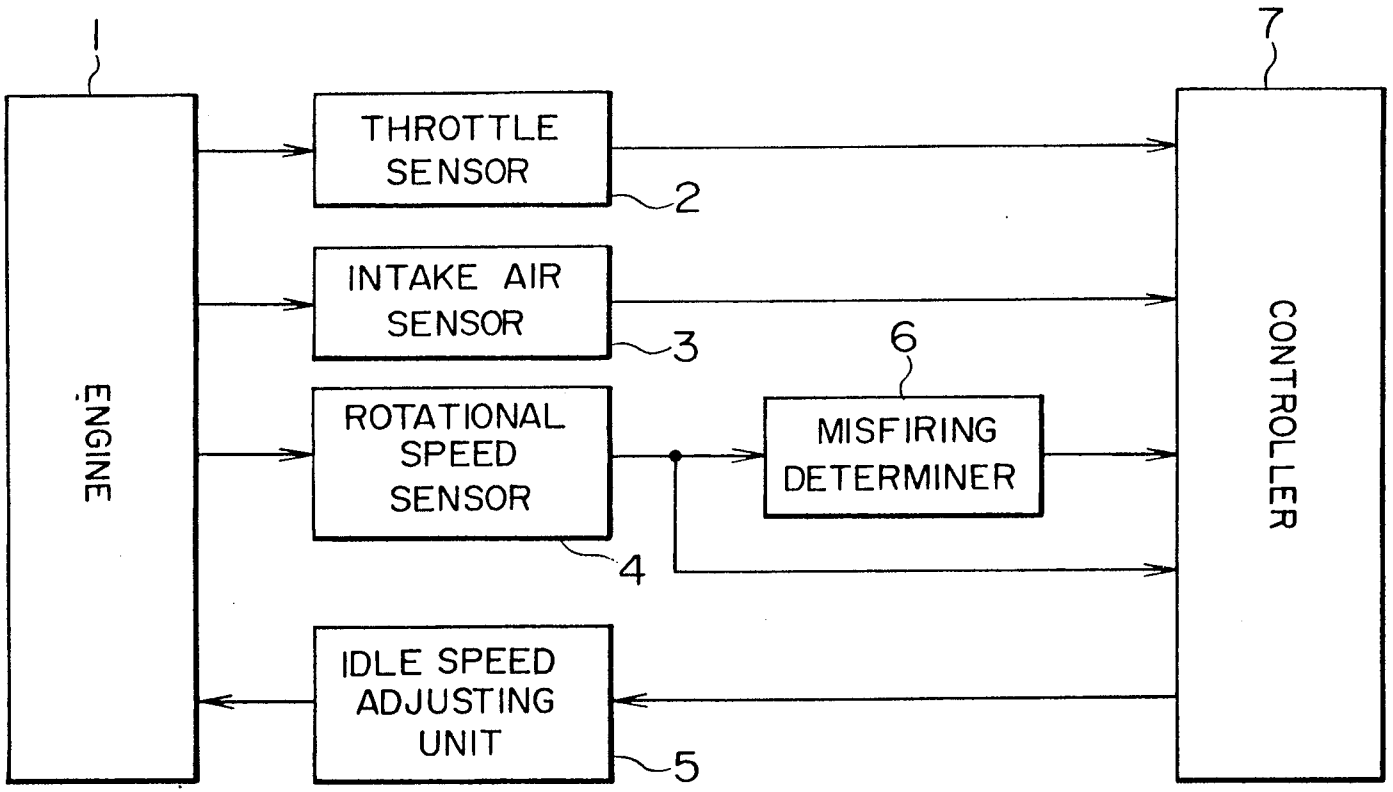
FIG. 1 is a functional block diagram showing the basic arrangement of an idle running control apparatus for an internal combustion engine according to an embodiment of the present invention.
Figure 2:
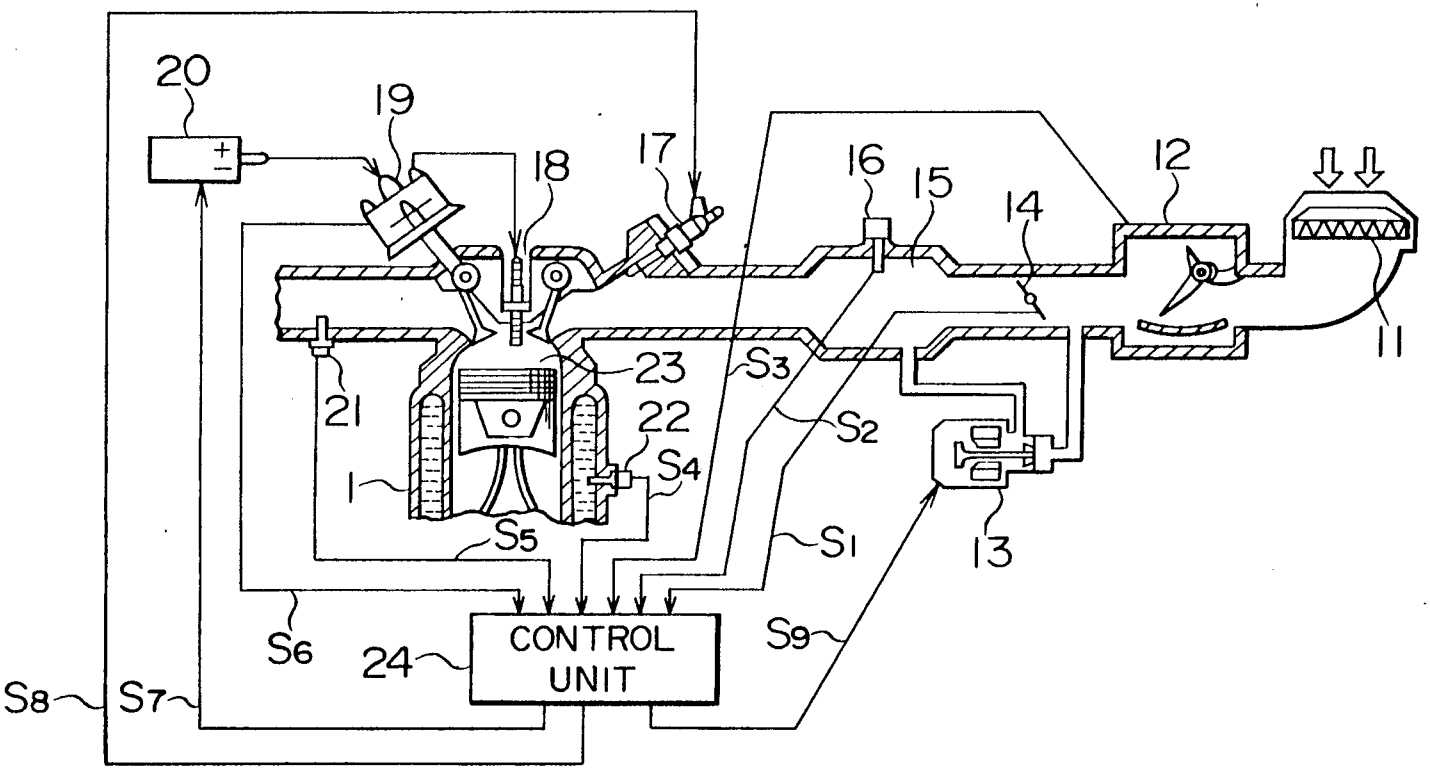
FIG. 2 is a schematic diagram showing an internal combustion engine of the electronically controlled fuel injection type to which an embodiment of the invention is applied.

FIG. 1 is a functional block diagram showing the basic arrangement of an engine idle running control apparatus according to an embodiment of the invention and FIG. 2 is a schematic diagram showing the structure of an internal combustion engine of the electronically controlled fuel injection type to which the teachings of the invention can be applied. Referring to FIG. 1, a reference numeral 1 generally denotes an internal combustion engine which is subjected to the control according to the teachings of the invention. A throttle sensor 2 senses the opening degree of a throttle valve 14, for example, by measuring the quantity of displacement or movement of an associated throttle actuator, as shown in FIG. 2, which sensor may be constituted, for example, by a throttle position sensor (not shown) or the like well known in the art. A throttle signal $S_1$ from the throttle sensor 2 representative of the opening degree of the throttle valve 14 is supplied to a controller 7 the operation of which will be described later. An intake air sensor 3, which is constituted by an air flow meter 12 shown in FIG. 2 or a throttle position sensor (not shown) or the like, senses the amount or flow rate of intake air sucked into the engine 1 and generates a corresponding output signal in the form of a load signal $S_3$ indicative of an engine load, which is also supplied to the controller 7. A rotational speed sensor 4 in the form of an angular velocity sensor senses the rotational speed or angular velocity (rad/sec) of the engine on the basis of a crank angle signal $S_6$ representative of a predetermined crank angle detected by a crank angle sensor 19 shown in FIG. 2. The rotational speed sensor 4 generates an output signal representative of the engine angular velocity is supplied to the controller 7 as well as to a misfiring determiner 6 which will also be described later.

Further, in FIG. 1, an idle speed adjusting unit 5 adjusts the flow of intake air sucked into the engine 1 while bypassing the throttle valve 14 during the idling operation of the engine 1, so as to allow the engine rotational speed (rpm) to attain a desired rotational number or speed. The idle speed adjusting unit 5 may be constituted, for example, by an idle control actuator 13 shown in FIG. 2 or the like. A misfiring determiner 6 serves to determine a difference in the angular velocity at two predetermined discrete time points in one engine cycle for thereby deciding on the occurrence of misfiring when the difference is smaller than a predetermined value. The output of the misfiring determiner 6 is also supplied to the controller 7, which is thus supplied as inputs thereto with the output signals of the above-mentioned sensors 2 to 4 and the output signal from the misfiring determiner 6, respectively, for thereby controlling the idle speed adjusting unit 5 through feedback control with a control gain previously set such that the engine can attain the desired rotational speed (rpm). The controller 7 is also responsive to the misfiring decision output of the misfiring determiner 6 to reduce the above-mentioned control gain in the feedback control so that the idle speed adjusting unit 5 is controlled to increase the idle running speed of the engine 1.

Referring to FIG. 2, an engine control unit 24 includes a central processing unit (CPU), memories such as ROMs, RAMs and others to serve for performing the functions of the misfiring determiner 6 and the idle running control of the controller 7 as mentioned above. Additionally, the control unit 24 performs a fuel control function for determining a basic fuel injection pulse width or duration (or duty cycle) corresponding to the intake air flow rate and the engine rotational speed. It also generates an actual fuel injection pulse signal $S_8$ having a pulse duration (or duty cycle) derived by correcting the above-mentioned basic injection pulse duration with a cooling water temperature signal $S_4$ representative of the temperature of the engine 1, which is generated by a temperature sensor 22, for thereby driving the fuel injector 17 by the drive signal S8. The control unit 24 further generates an optimal ignition timing signal S7 on the basis of the fuel injection pulse signal and the engine rotational speed, so that a spark plug 18 is thereby driven to generate a spark at an optimal ignition timing. Further, as shown in FIG. 2, the engine 1 includes an air cleaner 11, a surge tank 15, an intake air temperature sensor 16 for sensing the temperature of intake air and generating a corresponding output signal $S_2$, an ignition coil 20, an exhaust gas sensor 21 and engine cylinders 23 (only one is illustrated). Additionally, a symbol S9 designates a rotation feedback signal supplied to the idle control actuator 13 from the control unit 24.

Now, description will be turned to the operation of the illustrated embodiment of the invention.

Figure 3A:
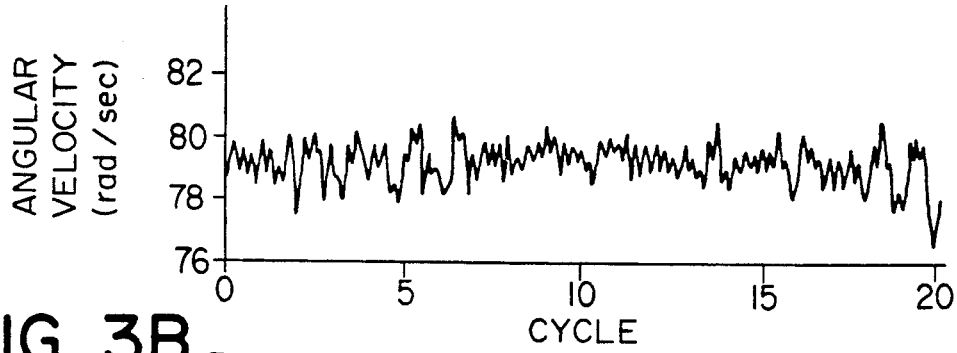
FIG. 3A is a view for graphically illustrating the behavior of angular velocity of the engine during an idle running operation of the engine.
Figure 3B:
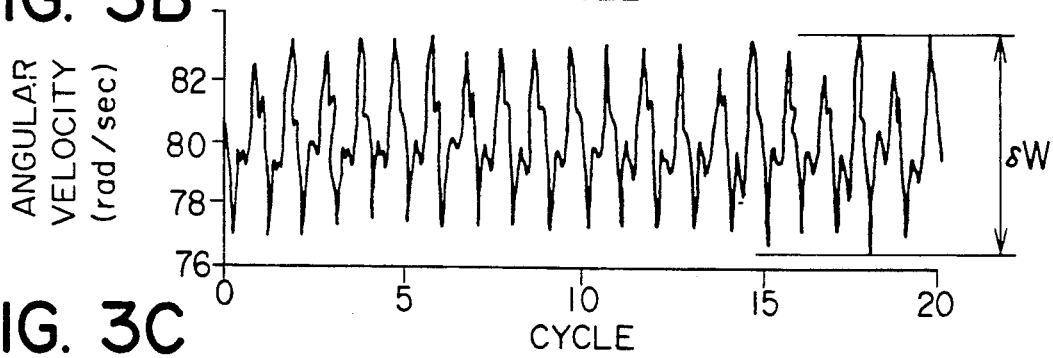
FIG. 3B is a view similar to FIG. 3A showing the behavior of the angular velocity upon the occurrence of misfiring in the engine.
Figure 3C:
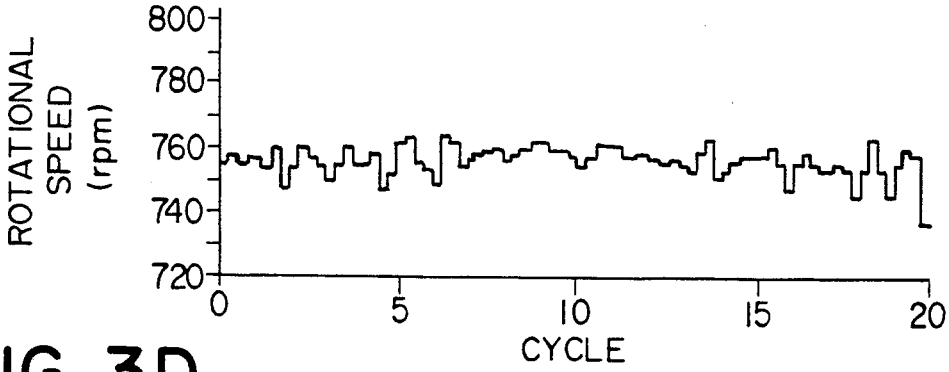
FIG. 3C is a view for graphically illustrating fluctuations in the engine rotational speed during the normal idle running operation of the engine.
Figure 3D:
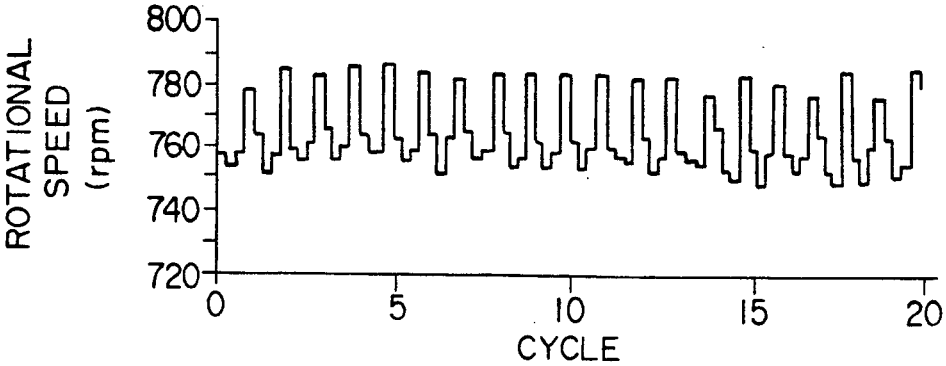
FIG. 3D is a view similar to FIG. 3C for illustrating fluctuations in the engine rotational speed upon the occurrence of misfiring during the idle running of the engine.

FIG. 3A shows the behavior of the angular velocity (rad/sec) of the engine during the idle operation thereof; FIG. 3B shows that of the angular velocity (rad/sec) upon occurrence of misfiring in the engine during idling; FIG. 3C shows fluctuations in the engine rotational speed (rpm) in the state shown in FIG. 3A; and FIG. 3D shows fluctuations in the engine rotational speed (rpm) in the state shown in FIG. 3B. In the case of the conventional idle running control apparatus as described before, the feedback control is performed by using a predetermined constant control gain such that the engine rotational speed (rpm) reaches a desired rotational speed independently of or regardless of the occurrence of misfiring in the engine. Consequently, the engine rotational speed derived through the conventional feedback control performed for the operation illustrated in FIG. 3D suffers a significant pulsation, as shown in FIG. 4A, which provides a cause for the occurrence of a hunting phenomenon.

Figure 4A:
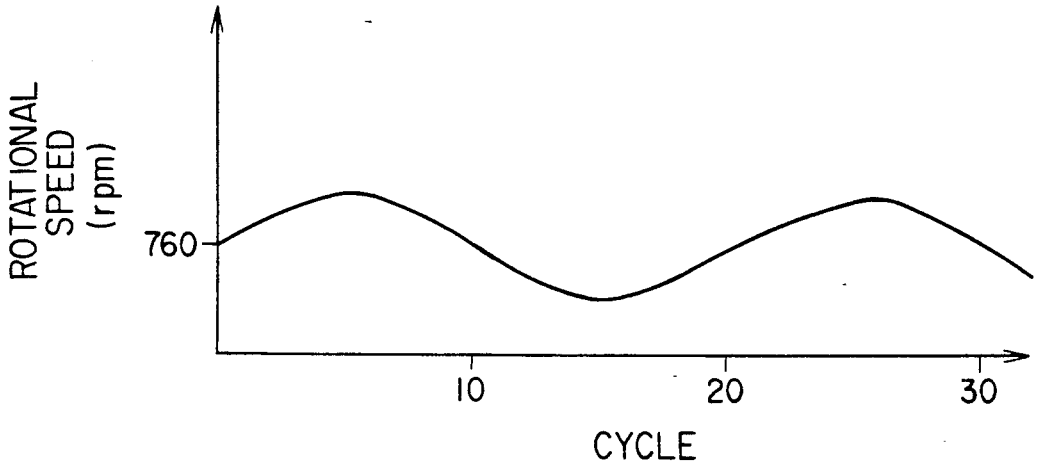
FIG. 4A is a view illustrating a pulsation in the engine rotational speed making appearance upon the occurrence of misfiring in the case of conventional idle running control.

With the teachings of the present invention incarnated in the first embodiment thereof, it is contemplated to prevent such a hunting phenomenon as illustrated in FIG. 4A from occurring due to misfiring in some of the engine cylinders.

With particular reference to the flow chart of FIG. 5, idle running control carried out by the idle running control apparatus according to the first embodiment of the invention will be described.

Figure 5:
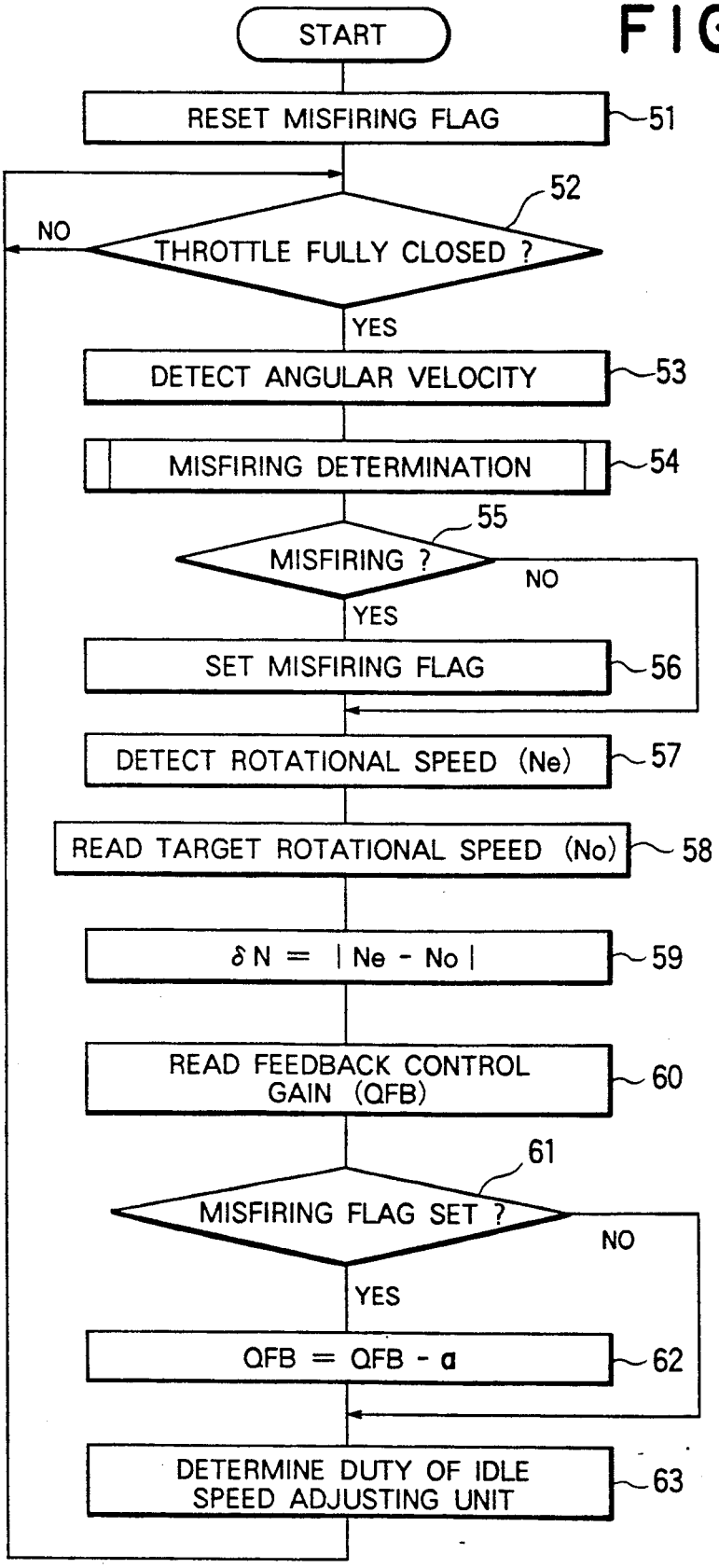
FIG. 5 is a flow chart for illustrating the idle running control according to a first embodiment of the invention.

Referring to FIG. 5, when an unillustrated key switch is turned on to start electric power supply, a misfiring decision flag is first reset to zero in step 51. After engine start-up has finished, a processing step 52 is executed. More specifically, in step 52, decision is made on the basis of the output of the throttle sensor 2 or the output of an idle switch (not shown), which is switched on when the throttle valve 14 is in the fully-closed state (i.e., idle position), as to whether the unillustrated throttle actuator or throttle valve 14 is in the fully-closed state. If this decision step 52 results in "NO", it is awaited until the throttle valve 14 becomes fully closed, whereupon a succeeding step 53 is executed. In step 53, the angular velocity at every predetermined crank angle is sensed from the output of the angular velocity sensor 4, which is then followed by the execution of a step 54. In this step 54, it is decided whether or not the magnitude of fluctuation or change δW in the angular velocity (rad/sec) (see FIG. 3B) exceeds a predetermined value or alternatively whether a mean value of the changes δ W averaged over several engine cycles exceeds a predetermined value. If the answer in step 54 is affirmative, then in step 55, it is determined that misfiring occurs in the engine. Consequently, in step 56, a misfiring flag is set up, and the processing then proceeds to step 57.

On the other hand, if the answer in step 54 is negative, it is determined in step 55 that the engine is not misfiring, and the processing then proceeds to the step 57 while skipping the step 56. In step 57, an actual or current rotational speed Ne (rpm) of the engine is detected from the output of the rotational speed sensor 4. Subsequently, in step 58, a desired or target rotational speed No corresponding to the current engine temperature as sensed is read out from an engine-temperature table which is previously stored in the control unit 24, for determining a difference δN between the actual rotational speed Ne and the desired rotational speed No in step 59.

In a next step 60, a feedback control gain table storing data of differences δN determined and collected experimentally or empirically is consulted or looked up to thereby read out from the table a control gain QFB which corresponds to the rotational speed difference δN determined in step 59. The control gain QFB thus read out is then stored in a memory incorporated in the control unit 24.

Next, in step 61, decision is made as to whether or not the misfiring flag has been set in step 56. When the misfiring flag is set, then a processing step 62 is executed. In this step 62, a predetermined value $\alpha$ is substracted from the control gain as stored in the memory in step 60 to thereby decrease the feedback control gain QFB, whereon the processing proceeds to a step 63. For example, such a value $\alpha$ may be a half of the feedback control gain QFB. If, however, the answer in the decision step 61 is negative, the step 63 is executed straightforwardly (i.e., without performing the gain subtraction processing mentioned above). In step 63, the operational duty of the idle speed adjusting unit 5 is determined in accordance with the gain QFB. Thus, the idle running feedback control is carried out by the corrected control gain QFB when the engine is misfiring so that the idle speed adjusting unit 5 properly adjusts the flow rate of intake air bypassing the throttle valve 14 during idling to stabilize the idle running speed of the engine, thus preventing hunting and an engine stall.

Figure 4B:
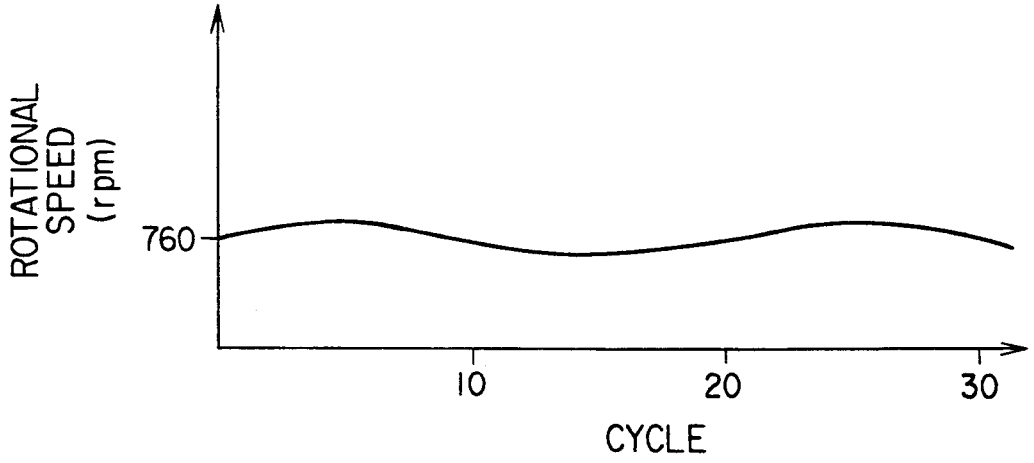
FIG. 4B is a view for graphically illustrating a pulsation in the engine rotational speed making appearance when the idle running control according to the invention is carried out.

According to the teachings of the invention incarnated in the first embodiment, the rotation feedback control gain is decreased upon occurrence of misfiring to thereby control the idle speed adjusting unit 5 with a lowered gain. As a result, pulsation in the engine speed can remarkably be suppressed, as can be seen in FIG. 4B, whereby the engine can positively be protected against hunting. In other words, there has been provided according to the first embodiment of the invention an idle running control apparatus for an internal combustion engine which has a misfiring decision function for effecting the rotational speed feedback control by reducing or lowering the control gain upon occurrence of misfiring in the engine to prevent hunting, for thereby ensuring improved stability of the engine idling operation and hence enhanced comfortableness in driving a car, to a great advantage.

Next, description will be made of a second embodiment of the idle running control apparatus according to the invention.

The hardware arrangement of the idle running control apparatus according to the second embodiment is essentially identical with that of the first embodiment except that the controller 7 shown in FIG. 2 is so implemented or programmed as to control the idle speed adjusting unit 5 such that the engine 1 attains a desired rotational speed previously stored in a table for a corresponding engine temperature and that upon occurrence of misfiring as decided by the misfiring determiner 6, the desired rotational speed mentioned above is so modified that the idle running speed is increased (idle-up control).

In conjunction with the idle running control according to the second embodiment of the invention, it should first be mentioned that in the case of the conventional idle running control, the engine rotational speed feedback control is performed such that the predetermined target or desired engine rotational speed, which is set as low as permissible for the normal state of idling operation, is attained even when misfiring takes place in the engine. As a consequence, the engine is likely to stall at the time points at which the engine speed becomes remarkably low, as is illustrated in FIG. 3D, due to overshoot in the feedback control or under the influence of electric loads imposed by an air conditioner, a power steering system and others.

With the second embodiment of the invention, it is contemplated to prevent such an engine stall even if the engine is misfiring during the idle running operation.

With particular reference to FIG. 6, the idle running control according to the second embodiment will be described. In FIG. 6, the processing from step 151 up to step 156 is the same as the control processing carried out in steps 51 through 56 of FIG. 5. Accordingly, repeated description of the steps 151 to 156 will be unnecessary. The following description is thus directed to processing steps 157 et seq. in which the control processing shown in FIG. 6 differs from that shown in FIG. 5.

In step 157, the actual engine speed Ne is determined from the output of the angular velocity sensor 4. In step 158, the desired engine rotational speed No corresponding to the engine temperature in the form of the engine cooling water temperature currently prevailing is read out form a table.

In step 159, decision is made as to whether the misfiring flag has been set in step 156. When the misfiring flag is set, a desired rotational speed correction quantity CNo corresponding to the current engine cooling water temperature is read out from a table which stores the correction quantities in correspondence with the engine or water temperatures. On the other hand, unless in step 159 the misfiring flag is set, the step 161 is executed to clear the correction quantity CNo.

In step 162, the correction quantity CNo read out in step 160 is added to the target or desired rotational speed No read out in step 158 to thereby correct or modify the desired rotational speed to a correspondingly greater value No*. In step 163, a difference δN between the actual rotational speed Ne and the corrected target or desired rotational speed No* is arithmetically determined.

Subsequently, in step 164, a control gain QFB corresponding to the difference δN determined in step 163 is read out from a table which contains the control gains in correspondence to the differences δN previously determined experimentally or empirically, whereby the duty of the idle speed adjusting unit 5 is determined to properly adjust the flow rate of intake air bypassing the throttle valve 14 such that the idle running speed of the engine is controlled to the corrected target speed.

As will be appreciated from the above description, the idle speed feedback control is performed by increasing the desired idle running speed upon occurrence of misfiring, whereby an engine stall can be prevented from occurrence even during the idle running operation of the engine.

While the invention has been described in terms of its preferred embodiments, it should be understood that numerous modifications may be made thereto without departing from the spirit and scope of the invention. It is intended that all such modifications fall within the scope of the invention.

What is claimed is:

1. An idle running control apparatus for an internal combustion engine, comprising:

a rotational speed sensor for sensing the rotational speed of the engine and generating a corresponding output signal;

a throttle sensor for sensing the degree of opening of a throttle valve and generating a corresponding output signal;

an intake air sensor for sensing the flow rate of intake air sucked into said engine and generating a corresponding output signal;

a misfiring determiner for determining an occurrence of misfiring in said engine on the basis of a change in magnitude of the output signal of said rotational speed sensor;

idle speed adjusting means for adjusting the idle running speed of said engine; and control means responsive to the outputs of said rotational speed sensor, said throttle sensor and said intake air sensor and said misfiring determiner for controlling said idle speed adjusting means through feedback control with a control gain previously set such that a desired engine rotational speed is thereby attained, wherein when said misfiring determiner determines an occurrence of misfiring, said control means decreases said control gain in the feedback control so that said idle speed adjusting means is thereby controlled to stabilize the idle running speed of said engine.

2. An idle running control apparatus according to claim 1, wherein said control gain is decreased in dependence on a difference between the actual running speed of the engine and a desired running speed which is previously determined in correspondence with the temperature of said engine.

3. An idle running control apparatus according to claim 2, wherein a relationship between the desired running speed and the engine temperature is previously contained in a table stored in said control means.

4. An idle running control apparatus according to claim 1, wherein said misfiring determiner determines the occurrence of misfiring when the magnitude of fluctuation in the output signal of said rotational speed sensor exceeds a predetermined value.

5. An idle running control apparatus according to claim 1, wherein said rotational speed sensor comprises an angular velocity sensor for sensing the angular velocity of said engine.

6. An idle running control apparatus according to claim 1, wherein said idle speed adjusting means adjusts the flow rate of intake air bypassing said throttle valve during idling.

7. An idle running control apparatus for an internal combustion engine, comprising:

a rotational speed sensor for sensing the rotational speed of the engine and generating a corresponding output signal;

a throttle sensor for sensing the degree of opening of a throttle valve and generating a corresponding output signal;

an intake air sensor for sensing the flow rate of intake air sucked into said engine and generating a corresponding output signal;

a misfiring determiner for determining an occurrence of misfiring in said engine on the basis of a change in magnitude of the output signal of said rotational speed sensor;

idle speed adjusting means for adjusting the idle running speed of said engine; and control means responsive to the outputs of said rotational speed sensor, said throttle sensor and said intake air sensor and said misfiring determiner for controlling said idle speed adjusting means through feedback control with a control gain previously set such that a desired engine rotational speed is thereby attained, wherein when said misfiring determiner determines an occurrence of misfiring, said control means increases said desired rotational speed by a predetermined amount.

8. An idle running control apparatus according to claim 7, wherein said predetermined amount is determined in correspondence to the temperature of said engine.

9. An idle running control apparatus according to claim 8, wherein a relationship between the predetermined amount and the engine temperature is contained in a table stored in said control means so that said predetermined amount can be read out from said table in relation to the engine temperature.

10. An idle running control apparatus according to claim 7, wherein said desired engine rotational speed is previously determined in correspondence to the temperature of said engine, and a relationship between the desired speed and the engine temperature is stored in a table so that said desired speed can be read out from said table in relation to the engine temperature.

* * * * *